United States Patent [19]

Giulie

[11] 4,385,225

[45] May 24, 1983

[54] HEATER UNIT FOR HEAT ACTIVATED BINDING AND FILING SYSTEMS

[76] Inventor: Joe D. Giulie, P.O. Box 10101, Palo Alto, Calif. 94303

[21] Appl. No.: 291,222

[22] Filed: Aug. 10, 1981

[51] Int. Cl.[3] ..... H05B 3/06

[52] U.S. Cl. ..... 219/521; 156/499; 219/512; 219/530; 412/900

[58] Field of Search ..... 219/521, 523, 530, 540, 219/512; 412/33, 34, 37, 41, 38, 900, 901, 902; 156/336, 499; 281/21 R

[56] References Cited

U.S. PATENT DOCUMENTS

| | | | |
|---|---|---|---|
| 3,816,705 | 6/1974 | Ebert | 219/521 |
| 3,953,277 | 4/1976 | Kuhns | 412/900 X |
| 3,992,741 | 11/1976 | Staats | 412/900 X |
| 4,108,713 | 8/1978 | Weisz | 156/499 |
| 4,141,100 | 2/1979 | Domroe et al. | 412/37 |
| 4,178,201 | 12/1979 | Power et al. | 156/499 |

*Primary Examiner*—Volodymyr Y. Mayewsky
*Attorney, Agent, or Firm*—Robert G. Slick

[57] ABSTRACT

A heater unit is provided for activating a heat sensitive adhesive binder system. The unit has simplified control and indicator means.

5 Claims, 6 Drawing Figures

HEATER UNIT FOR HEAT ACTIVATED BINDING AND FILING SYSTEMS

SUMMARY OF THE INVENTION

The present invention relates to a simplified heater system which is primarily designed for use with the heat sensitive binding system of my co-pending patent application identified as Ser. No. 290,521, filed Aug. 6, 1981. Although the invention is primarily applicable for use with such a system, it will be readily apparent that it can be used in any application where it is desired to provide and accurately control a source of heat with a simplified timer circuit.

In accordance with one embodiment of the invention, the heater unit is made very narrow with open ends so that files which might have tabs at the top, bottom or sides can be placed in the heater without interference from the tabs. Also, such a unit with open ends allows the unit to be narrower than a page length.

In accordance with the preferred embodiment of the invention, the heater unit also incorporates a cooling slot so that after the adhesive melts, the file may be placed in the cooling unit while the adhesive sets.

In accordance with still another embodiment of the present invention, the heating and cooling unit is adapted to be placed over the end of a metal file cabinet so that the file cabinet acts as a heat sink insuring rapid cooling while not taking up desk top space.

A basic feature of the present invention is that the heater plate itself is used to actuate a switch to turn the heater off when the heater plate has reached a desired temperature.

Other objects and features of the invention will be brought out in the balance of the specification.

BRIEF DESCRIPTION OF THE DRAWINGS

FIG. 4 is a perspective view of another embodiment of the invention wherein the unit is designed for placing on a desk top or the like.

DESCRIPTION OF THE PREFERRED EMBODIMENT

Figure 1:
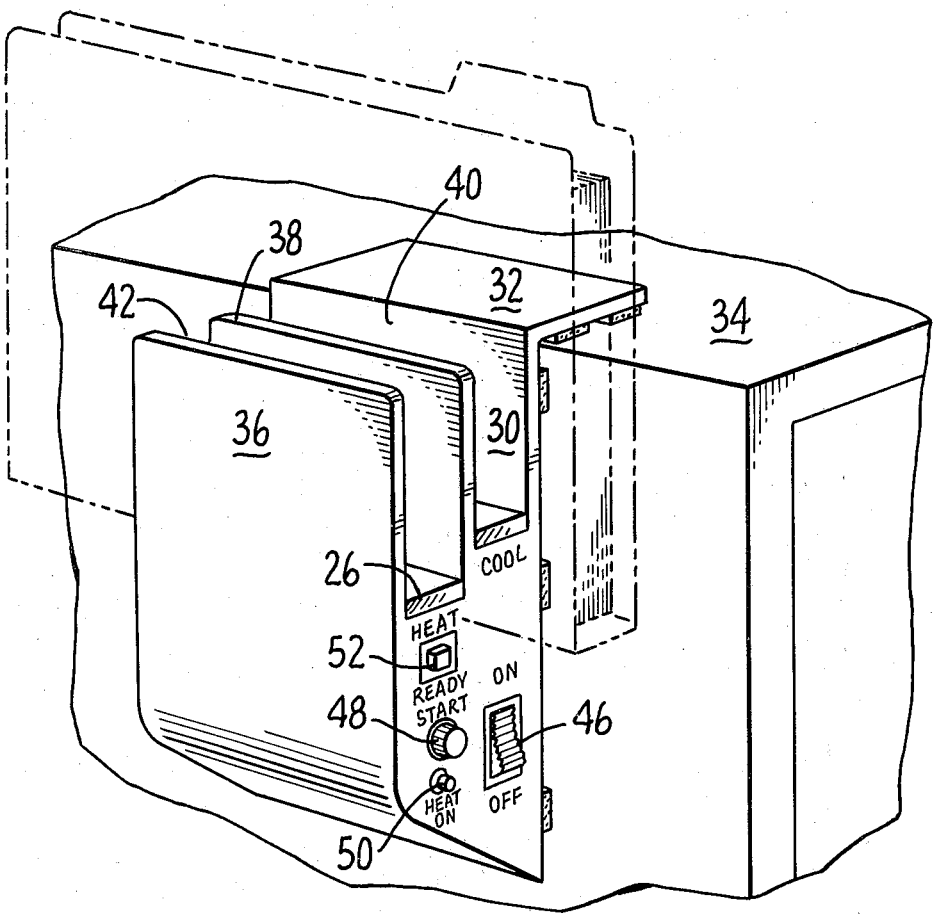
FIG. 1 is a perspective view of a heating and cooling unit embodying the present invention wherein the unit is mounted on a filing cabinet.
Figure 2:
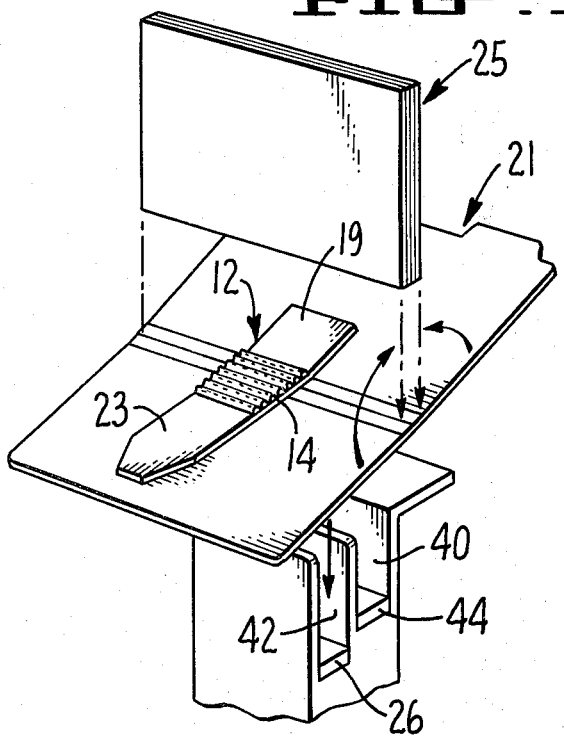
FIG. 2 is a perspective view showing how the unit is used to conduct a binding operation.
Figure 3:
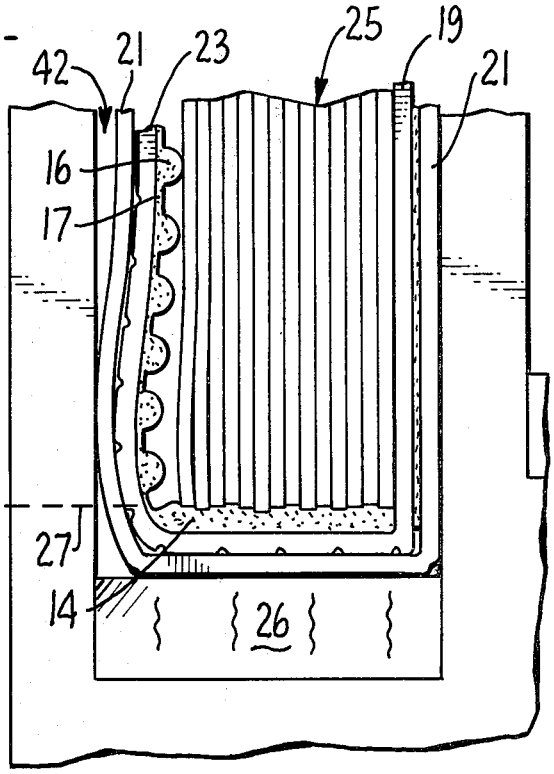
FIG. 3 is an enlarged section through the bottom portion of the heating unit.

Referring now to the drawing by reference characters, there is shown in FIGS. 1–3 a heater embodying the present invention. In the embodiment illustrated, two slots are provided, one for heating and one for cooling after a file or the like has been heated to binding temperature. It will be understood that the essence of the present invention lies in the heating unit and that the cooling unit is incorporated merely as a matter of convenience. In many instances, only the heater would be employed.

The heating unit of the present invention has a wall 30 and a right angle extension 32 thereto which are adapted to fit over the corner of a metal filing cabinet

34. The unit has an outer wall 36 and an intermediate wall 38 forming two U-shaped cavities 40 and 42. At the bottom of the cavity 42 is a heater plate 26 while the bottom of the cavity 40 has an unheated plate 44. It is convenient to make the cavities of different depths, as illustrated, for ease of removing folders. The unit is provided with an on/off switch 46, a start button 48, a heat-on indicator light 50, and a ready light 52. The method of operating the device can best be seen with reference to FIGS. 2 and 3. Here a file folder 21 is provided having a binding strip 12, the binding strip having ends 19 and 23, with an intermediate portion 14 provided with a heat activated adhesive having peaks 16 and valleys 17. End 19 would ordinarily be glued to the file folder 21 while the balance of the binding strip is free to bend over a sheaf of papers. When it is desired to bind a sheaf of papers 25, the papers are placed over the center of the binder strip 12 and the heat activated adhesive and the covers of the binder are folded together and brought into contact with the sheaf of papers as is shown by the curved arrows in FIG. 2. Now the file folder is pressed downwardly into the slot 42 so that the back of the folder is in contact with the heater plate 26. At this point the switch 46 is turned on and ready light 52 is on while the heat-on light 50 is off. Now one presses the start button 48 and the heat-on light 50 will go on. After the unit comes up to temperature the heat-on light will go off and the ready light will go on. At this point, the folder would be removed from the slot 42 and placed in the slot 40 to allow the heat setting adhesive to set. The ready light is on, indicating that the device is ready for a repetition of the cycle.

Figure 4:
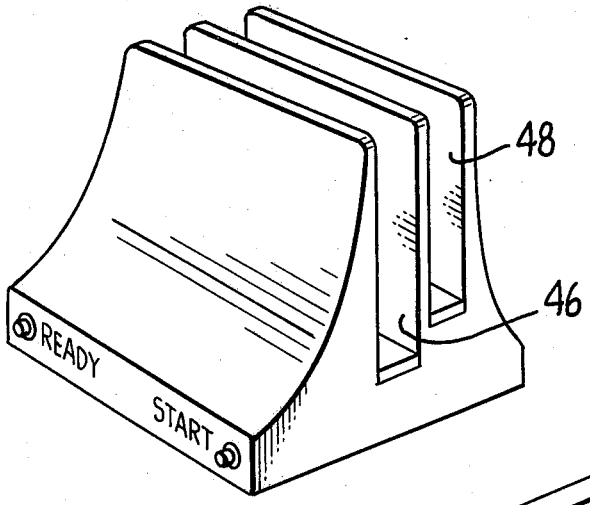

FIG. 4 illustrates another embodiment of the invention which is suitable for placing on a desk. This device has two slots 46 and 48 and the device has a flat bottom so that it can sit on any flat surface. Otherwise, the structure is exactly as has been previously described.

Figure 5:
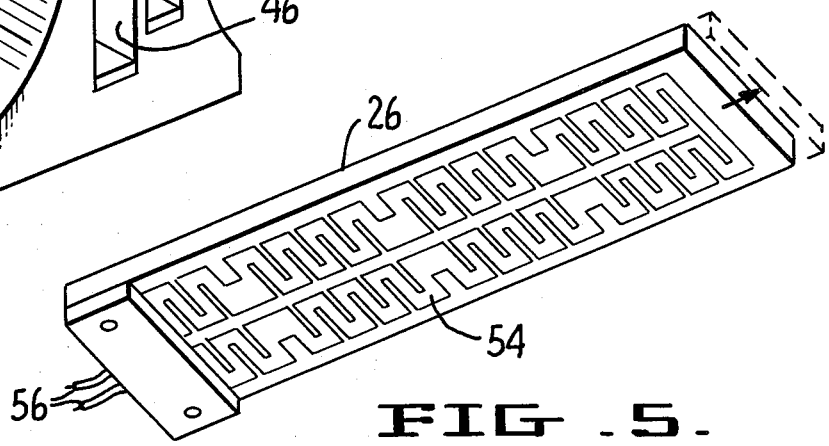
FIG. 5 is a perspective view of a printed circuit heater and heater plate which is utilized in accordance with the present invention.

FIG. 5 illustrates the printed circuit heater which is employed in carrying out the present invention. Such heaters are well known to those skilled in the art and consists of a printed resistance element 54 which may be encapsulated between two thin layers of heat resistant plastic. Conductors 56 convey electricity to the resistance element. In this embodiment, the printed circuit is mounted under plate 26 which forms the bottom of the slot 42. In use, the element and the plate 26 will expand in the direction shown by the arrow so that when hot, the device will be lengthened as is shown in dash lines. Advantage is taken of this lengthening effect to shut off the heater as is later explained in detail.

Figure 6:
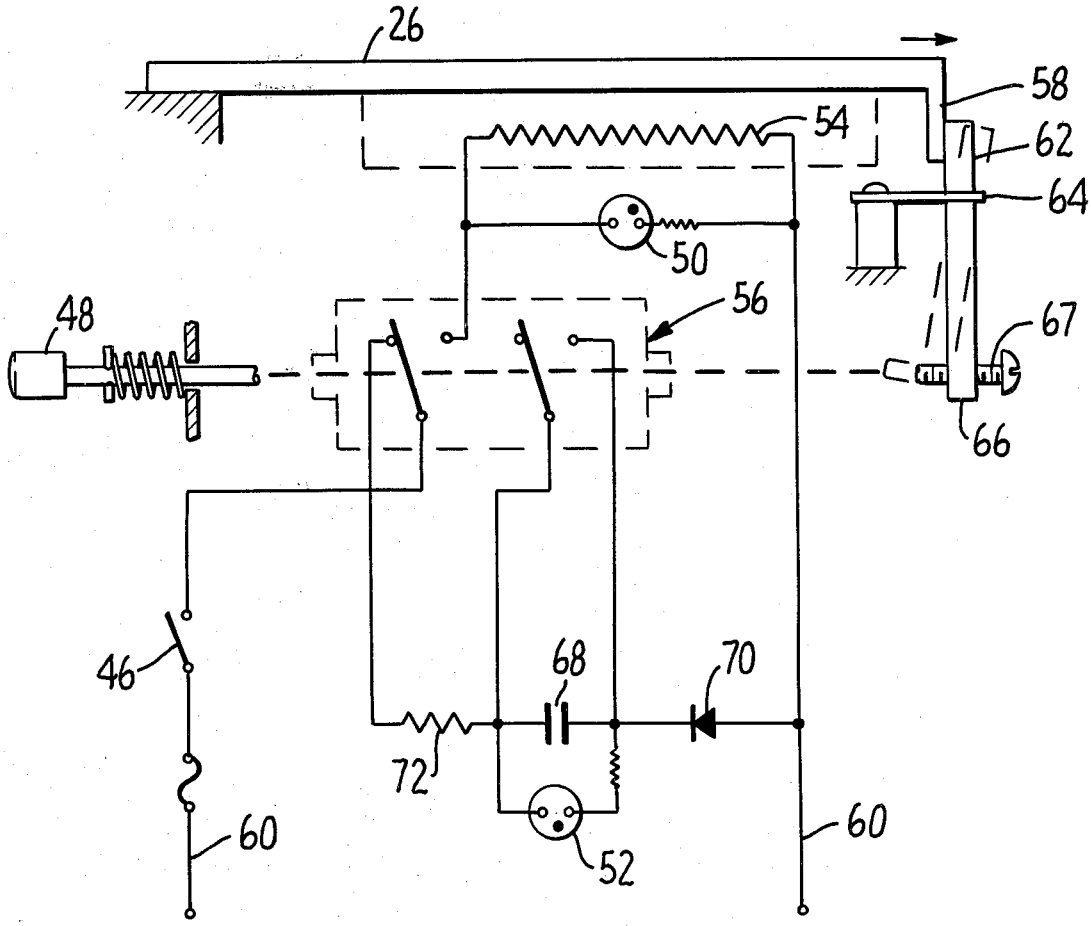
FIG. 6 is a schematic diagram of the electric circuit employed in carrying out the present invention.

FIG. 6 is a schematic diagram showing the arrangement of the various parts in a practical embodiment of the invention. Switch 46 is a line switch and would normally be closed during periods when the device is to be used. The device is actuated by a double pole/double throw snap-action switch 56. The switch 56 is mounted under the plate 26 and an extension 58 on the plate 26 is in contact with arm 62. The opposite end of plate 26 is anchored to a frame member as is shown at the lefthand side of FIG. 6. When it is desired to initiate an operation, button 48 is pushed, moving the contacts of switch 56 to the right, connecting the line 60 to the heater element 54 and at the same time shorting out the glow lamp 52. During the time when heater 54 is on, the lamp 50 will glow. As the plate 26 warms up, it expands, causing the arm 58 to move to the right in the direction shown by the arrow. This presses upon lever arm 62 which is mounted on flexible arm 64 causing the lower end of the lever arm 66 to move to the left, as is shown in phantom, snapping the contacts of the switch 56 to the position shown in solid lines. An adjustment screw 67 allows one to adjust the temperature at which the device turns off. This, of course, turns off heater 54 and lamp 50 and causes capacitor 68 to start charging through diode 70 and a relatively low value resistor 72. After a slight delay capacitor 68 will become charged and this will cause light 52 to come on and it will remain on showing that the device is ready for a repetition of the cycle. Light 52 will continue to glow as long as switch 46 is on until one again pushes button 48. This will not only turn on heater 54 for a repetition of the cycle but also will short out the light 52 showing that the device is in service and is not yet ready for a repetition of the cycle. Thus, a simple automatic cycling device has been provided for controlling the heater circuit.

In the embodiment illustrated, the expansion of plate 26 was insufficient to directly activate switch 56. If a longer plate is employed or if a more sensitive switch is employed, it is not necessary to employ the motion multiplying lever 62 for then the switch can be directly activated by the expansion of the plate.

Although specific embodiments of the device have been shown, many variations can be made within the spirit of this invention.

Subject matter to be claimed is:

1. A heating device for a heat activated binder system comprising in combination:

a. parallel spaced side walls connected to a bottom wall defining a U-shaped slot for holding an article to be heated and bound, b. an electrical heating element positioned on the bottom wall of said slot and switch means activated in one direction by heat expension from said heating element whereby said switch means shuts off current to said heating element after a desired amount of heat has been developed, c. said switch means including a two position snap action switch having an "off" position and an "on" position with manual means for moving said switch from the "off" position to the "on" position and means activated by heat expansion to snap said switch to the "off" position when a desired temperature has been reached whereby said switch remains in "off" position until it is again manually actuated to the "on" position.

2. The heating device of claim 1 wherein said heating element includes an arm attached thereto, to actuate said switch means.

3. The heating device of claim 1 having in combination therewith a second slot, said second slot being unheated.

4. A device in accordance with claim 3, having an arm extending from the top at one side of the cooling slot permitting said device to be attached to a metal file cabinet with one side of the cooling slot of said arm in contact with said cabinet whereby the file cabinet acts as a heat sink for cooling.

5. The heating device of claim 1 having an expansion arm associated with said heating element, said expansion arm serving to disconnect said heating element when said arm expands.

* * * * *